US009997152B2

(12) United States Patent
Nicolai et al.

(10) Patent No.: US 9,997,152 B2
(45) Date of Patent: Jun. 12, 2018

(54) SOUND GENERATOR FOR MOUNTING ON A VEHICLE TO MANIPULATE VEHICLE NOISE

(71) Applicant: Eberspächer Exhaust Technology GmbH & Co. KG, Neunkirchen (DE)

(72) Inventors: Manfred Nicolai, Esslingen (DE); Thomas Schmidt, Steinheim (DE); Jan Krüger, Neuhausen (DE)

(73) Assignee: Eberspächer Exhaust Technology GmbH & Co. KG, Neunkirchen (DE)

( * ) Notice: Subject to any disclaimer, the term of this patent is extended or adjusted under 35 U.S.C. 154(b) by 0 days. days.

(21) Appl. No.: 15/341,496

(22) Filed: Nov. 2, 2016

(65) Prior Publication Data

US 2017/0133003 A1 May 11, 2017

(30) Foreign Application Priority Data

Nov. 6, 2015 (DE) ..... 10 2015 119 191

(51) Int. Cl.
*G10K 11/16* (2006.01)
*G10K 11/178* (2006.01)
(Continued)

(52) U.S. Cl.
CPC ..... *G10K 11/1788* (2013.01); *F01N 1/065* (2013.01); *F01N 1/166* (2013.01);
(Continued)

(58) Field of Classification Search
CPC ..... F01N 1/065; F01N 13/1888; F01N 1/166; F01N 2560/028; G10K 11/1788;
(Continued)

(56) References Cited

U.S. PATENT DOCUMENTS 4,058,349 A * 11/1977 Ury ..... B60T 13/263 137/107
4,144,416 A * 3/1979 Babb ..... H04R 9/022 181/150
(Continued)

FOREIGN PATENT DOCUMENTS

DE 197 51 596 A1 6/1999
DE 10 2006 042 224 B3 1/2008
(Continued)

*Primary Examiner* — Norman Yu
(74) *Attorney, Agent, or Firm* — McGlew and Tuttle, P.C.

(57) ABSTRACT

A sound generator (100) mounts on a vehicle to manipulate vehicle noise originating from a vehicle operated by an internal combustion engine. The sound generator (100) includes a casing (110), a loudspeaker (120), and at least one pressure compensation valve (130). The loudspeaker (120) and the casing (110) together thereby enclose a volume (115). Further, the pressure compensation valve (130) couples the volume (115) enclosed by the loudspeaker (120) and the casing to an outside of the casing (110). The pressure compensation valve (130) thereby extends through a plane in which the loudspeaker (120) is located. A system (200) for manipulating sound waves propagating through exhaust systems of vehicles driven by an internal combustion engine uses the above sound generator (100).

17 Claims, 6 Drawing Sheets

(51) Int. Cl.

| | |
|---|---|
| ***F01N 13/18*** | (2010.01) |
| ***F01N 1/06*** | (2006.01) |
| ***F01N 1/16*** | (2006.01) |
| *H04B 1/00* | (2006.01) |
| *H04R 9/06* | (2006.01) |

(52) U.S. Cl.
CPC ... *F01N 13/1866* (2013.01); *G10K 2210/127* (2013.01); *G10K 2210/128* (2013.01); *H04R 9/06* (2013.01); *H04R 2499/13* (2013.01)

(58) Field of Classification Search
CPC .. G10K 13/00; G10K 15/02; G10K 2210/112; G10K 2210/127; G10K 2210/128; G10K 2210/12822; H04R 9/022; H04R 2499/13; H04R 9/06; B60K 13/04; F02M 35/125
USPC ..... 381/71.4, 338, 386, 61, 71.5, 86; 181/206
See application file for complete search history.

(56) References Cited

U.S. PATENT DOCUMENTS

| | | | | |
|---|---|---|---|---|
| 4,177,874 | A | 12/1979 | Angelini et al. | |
| 5,229,556 | A | 7/1993 | Geddes | |
| 5,233,137 | A * | 8/1993 | Geddes | F01N 1/065 181/206 |
| 5,336,856 | A | 8/1994 | Krider et al. | |
| 5,343,533 | A | 8/1994 | Geddes | |
| 5,432,857 | A | 7/1995 | Geddes | |
| 5,571,633 | A * | 11/1996 | Hagiuda | H01M 2/1016 429/100 |
| 5,600,106 | A | 2/1997 | Langley | |
| 5,619,020 | A | 4/1997 | Jones et al. | |
| 5,703,337 | A * | 12/1997 | Geisenberger | F01N 1/065 181/206 |
| 8,722,396 | B2 * | 5/2014 | Kassebaum | C12M 21/02 435/257.1 |
| 2006/0016426 | A1 * | 1/2006 | Yamamoto | F02D 9/101 123/336 |
| 2006/0037808 | A1 | 2/2006 | Krüger et al. | |
| 2008/0053747 | A1 | 3/2008 | Krueger et al. | |
| 2009/0255754 | A1 | 10/2009 | Kruger et al. | |
| 2011/0000734 | A1 | 1/2011 | Krüger et al. | |
| 2013/0092471 | A1 * | 4/2013 | Kruger | F01N 13/1888 181/252 |
| 2013/0202148 | A1 * | 8/2013 | Grupp | H04R 1/025 381/389 |
| 2014/0105439 | A1 * | 4/2014 | Wirth | H04R 1/00 381/338 |
| 2014/0328493 | A1 | 11/2014 | Wirth et al. | |
| 2015/0159527 | A1 | 6/2015 | Nording et al. | |

FOREIGN PATENT DOCUMENTS

| | | | |
|---|---|---|---|
| DE | 10 2008 018 085 | A1 | 10/2009 |
| DE | 10 2009 031 848 | A1 | 1/2011 |
| DE | 10 2012 201 725 | A1 | 8/2013 |
| DE | 10 2013 208 186 | A1 | 11/2014 |
| DE | 10 2013 113 803 | A1 | 6/2015 |
| EP | 0 373 188 | B1 | 12/1993 |
| EP | 0 674 097 | A1 | 9/1995 |
| EP | 0 755 045 | A2 | 1/1997 |
| EP | 0 916 817 | A2 | 5/1999 |
| EP | 1 055 804 | A1 | 11/2000 |
| EP | 1 627 996 | A1 | 2/2006 |
| EP | 2 607 640 | A1 | 6/2013 |
| EP | 2 623 737 | A1 | 8/2013 |
| JP | 2013-87773 | A | 5/2013 |
| JP | 2013-160231 | A | 8/2013 |
| JP | 2014-219003 | A | 11/2014 |
| WO | 94/22403 | A1 | 10/1994 |

* cited by examiner

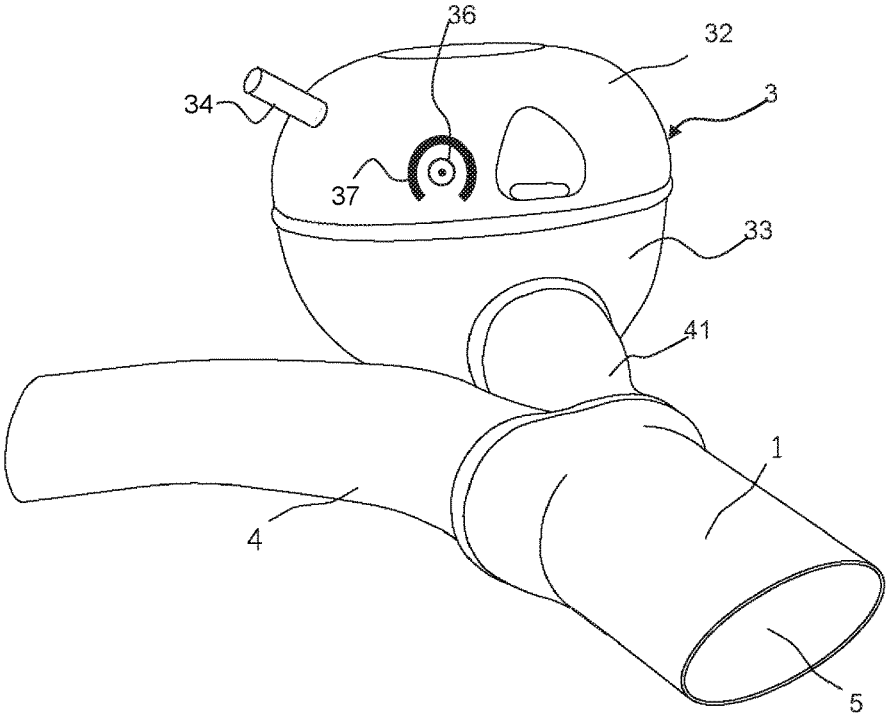
Figure 1A – prior art
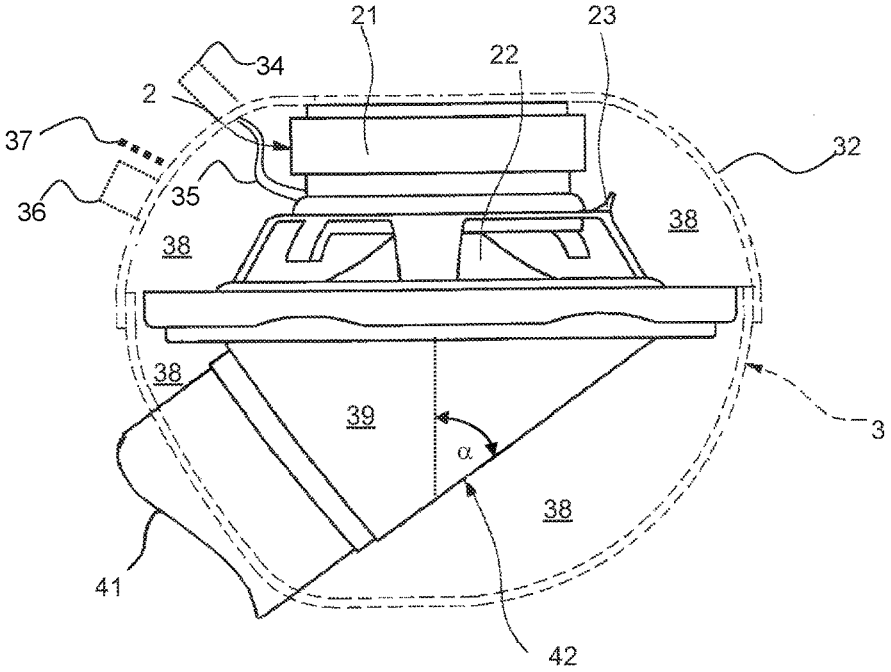
Figure 1B – prior art

SOUND GENERATOR FOR MOUNTING ON A VEHICLE TO MANIPULATE VEHICLE NOISE

CROSS REFERENCE TO RELATED APPLICATIONS

This application claims the benefit of priority under 35 U.S.C. § 119 of German Application 10 2015 119 191.1 filed Nov. 6, 2015, the entire contents of which are incorporated herein by reference.

FIELD OF THE INVENTION

The invention relates to a sound generator for mounting on a vehicle to manipulate vehicle noise. The vehicle may be a vehicle driven by an internal combustion engine or electrically, and in particular a motor vehicle. The sound generator may, in particular, be part of a system for manipulating sound waves traveling through exhaust systems of vehicles driven by an internal combustion engine.

BACKGROUND OF THE INVENTION

Irrespective of the internal combustion engine type (for example piston engine, rotary engine or free-piston engine), noises are generated due to the cycle of strokes (notably the induction and compression of an air fuel mix, power, and exhaust of the combusted air fuel mix). Part of the noise propagates through the combustion engine in the form of structure-borne noise and is then emitted from the combustion engine's outside in the form of airborne noise. Another part of the noise travels, together with the combusted air fuel mix, in the form of airborne noise through an exhaust system that is in fluid communication with the internal combustion engine. The noise traveling through the exhaust system in the form of airborne noise is called exhaust noise.

Other noises generated by vehicles driven by an internal combustion engine are the tire rolling noise on the roadway surface and the aerodynamic noise due to air displacement while the vehicle is moving.

These noises are often regarded as being harmful. Accordingly, there are statutory provisions for noise control to be observed by manufacturers of vehicles driven by internal combustion engines. The statutory provisions usually specify a maximum allowable sound pressure for a vehicle in operation. In addition, manufacturers try to give a distinctive noise emission to their vehicles driven by internal combustion engines, fitting the image of the respective manufacturer and favored by their customers. With state of the art small-displacement engines, it is no longer possible to achieve such a distinctive noise emission in a natural way.

Noise propagating through the internal combustion engine in the form of structure-borne noise can be deadened well and is therefore generally not an issue with regard to noise control.

Exhaust noise that propagates through an exhaust system of an internal combustion engine in the form of airborne sound, together with the combusted air fuel mix, is mitigated by mufflers located upstream of the discharge opening and, when present, downstream of catalytic converters. Respective mufflers may operate, for instance, according to at least one of the absorption and reflection principle. The drawback of both modes of operation is that they require a comparatively large volume, and build up a relatively high resistance to the combusted air fuel mix, thereby reducing the overall efficiency of the vehicle and increasing its fuel consumption.

For quite some time, so-called anti-noise systems have been developed as an alternative or complement to mufflers which add electro acoustically generated anti-noise to airborne noise generated in the internal combustion engine and traveling through the exhaust system. Respective anti-noise systems usually use a so-called Filtered-x Least Mean Squares (FxLMS) algorithm that tries to reduce the noise propagating through the exhaust system to zero (in the case of noise cancellation) by emitting sound from at least one sound generator (e.g. a voice coil loudspeaker or a different acoustic actor) that is in fluid communication with the exhaust system or to a predetermined threshold (in the case of active noise manipulation). To achieve complete destructive interference between the sound waves of the airborne noise traveling through the exhaust system and the anti-noise generated with the sound generator, the sound waves from the sound generator have to have the same amplitude and frequency as the sound waves propagating through the exhaust system but are shifted by 180 degrees in phase. When the sound waves propagating through the exhaust system have the same frequency as the sound waves of the anti-noise generated at the sound generator with their phases shifted by 180 degrees with respect to each other, but do not correspond in amplitudes, the sound waves of the airborne noise propagating through the exhaust system is only mitigated. The FxLMS algorithm calculates the anti-noise for each frequency band of the airborne noise propagating through the exhaust system separately by identifying an appropriate frequency and phasing for two sinusoidal oscillations that are shifted by 90 degrees with respect to each other and calculating the required amplitudes for these sinusoidal oscillations. Anti-noise systems aim at the noise cancellation or noise manipulation being audible and measurable at least outside of, but if need be also inside, the exhaust system. Establishing a control signal for generating a desired anti-noise with a sound generator is known to a person skilled in the art from documents U.S. Pat. No. 4,177,874, U.S. Pat. No. 5,229,556, U.S. Pat. No. 5,233,137, U.S. Pat. No. 5,343,533, U.S. Pat. No. 5,336,856, U.S. Pat. No. 5,432,857, U.S. Pat. No. 5,600,106, U.S. Pat. No. 5,619,020, EP 0 373 188, EP 0 674 097, EP 0 755 045, EP 0 916 817, EP 1 055 804, EP 1 627 996, DE 197 51 596, DE 10 2006 042 224, DE 10 2008 018 085 and DE 10 2009 031 848. A description of further details is therefore omitted. In this respect it is noted that the term "anti-noise" is used in this document to discriminate between the engineered sound from the sound generator and exhaust noise or other noises originating from the internal combustion engine. By itself, the anti-noise is nothing else than ordinary noise (usually airborne noise).

Creating noise from anti-noise systems may be implemented by coupling the sound generator acoustically to the exhaust system. As an alternative it is also known to mount the sound generator separately from the exhaust system, e.g. at the underbody of a vehicle rear, in order to emit the anti-noise from there. Irrespective of the sound generator being mounted in fluid communication with the exhaust system or separate from the exhaust system at a vehicle's underbody, placing the sound generator on the underbody of a vehicle causes several problems: firstly, the space available is usually very limited requiring a very compact design of the muffler, secondly, the sound generator has to be protected from environmental influences, and in particular from water and contamination.

As an example for respective sound generators, a sound generator for generating anti-noise in order to manipulate sound waves propagating through an exhaust system of a vehicle driven by an internal combustion engine is described below with respect to FIGS. 1A and 1B.

The sound generator 3 illustrated in the perspective view of FIG. 1A comprises an inherently stable two-part casing formed by an upper shell 32 and a lower shell 33 put together in an airtight manner. The casing houses an electrodynamic loudspeaker 2 and is connected to an exhaust system via a Y-pipe 1. At the base of the "Y", the Y-pipe has a port 5 for discharging exhaust gas traveling through the exhaust system 4 and noise generated by the loud speaker 2. By having the connection implemented with the Y-pipe, the thermal stress of the loudspeaker 2 disposed within the sound generator 3 due to the exhaust gas traveling through the exhaust system 4 is kept low. This is necessary, because conventional loudspeakers are configured to be operated in a range up to a maximum of 200° C. only, while the temperature of the exhaust gases traveling through the exhaust system 4 may be between 400° C. and 700° C. A pressure compensation valve 36 is disposed on the upper shell 32 of the casing. To protect the pressure compensation valve 36 positioned on the surface of the upper shell 32 from being damaged, the upper shell 32 also supports a cast metal ring 37 surrounding the pressure compensation valve 36. The ring 37 has a slot at its bottom for allowing liquid to drain off from the region surrounded by the ring 37. Finally, the upper shell 32 holds a cable bushing 34 through which connecting wires are fed-through into the inside of the sound generator 3.

FIG. 1B shows a schematic cross section through the sound generator 3 of FIG. 1A. As can be seen, the loudspeaker 2 comprises a voice coil type loudspeaker 2, a permanent magnet 21, and a bell-mouthed membrane 22 which are together supported by a loudspeaker basket 23. Hereby, the membrane 22 is connected at its radial outside to the loudspeaker basket 23 by an elastic surround (not shown) and comprises at its radial inside a voice coil (not shown) that moves in bores formed in the permanent magnet 21. By applying an alternating current to the voice coil, a Lorentz force is exerted onto the membrane 22 by the voice coil resulting in an oscillation of the membrane 22. Wires 35 supply the control signals required for operating the voice coil through the cable bushing 34 disposed on the upper shell 32 of the casing. At its radial outside, the loudspeaker basket 23 is supported by a bell mouth 42 connected to the Y-pipe 1 via a connecting pipe 41. The bell-mouth 42 has to be used in the example shown, since the area of the loudspeaker's 2 membrane 22 is larger than the cross-sectional area of the exhaust system 4 in the sound coupling region. The large area of the membrane 22 is necessary to achieve the required sound energy flux. The bell-mouthed membrane 22 defines an axis of symmetry forming an angle of 33° with the bottom of the bell mouth 42. The membrane 22, the surround, a fringe of the loudspeaker basket 23, and the bell 42 divide the volume enclosed by the casing into a rear volume 38 that is not in fluid communication with the Y-pipe 1, and a front volume 39 that is in fluid communication with the Y-pipe 1. The rear volume 37 is thus basically sealed and acts as an air cushion onto the membrane 22 of the loudspeaker 2. The front volume 39 corresponds basically to the volume enclosed by the bell 42 and is not sealed. Depending on the (air) pressure in the rear volume 37 being higher or lower than the (air) pressure in the front volume 39, the rear volume 37 dampens the membrane 22 to a greater or lesser extent and may also cause a deflection of the membrane 22 to only one side from its zero position. Operating the loudspeaker 2 with a respective one-sided displacement of the membrane 22 from its zero position results in a considerable reduction of its life expectancy. The pressure compensation valve 36 ensures that a pressure inside the casing is approximately the same as a pressure outside of the casing. By providing the pressure compensation valve 36, the pressure inside the rear volume 38 is continuously adapted to the pressure present outside the casing of the sound generator 3. This is supposed to prevent a one-sided displacement of the membrane 22 from its zero position.

A drawback of the above configuration is that the sound generator's pressure compensation valve frequently functions unreliably. One reason being that the pressure compensation valve is easily damaged by impacts from the outside; the other that dust and water may easily clog the pressure compensation valve making any pressure compensation impossible. Since pressure compensation valves are often designed for air to pass through but not for water to pass through, pressure compensation is often not possible, particularly when the pressure compensation valve of the sound generator is located below the surface of a water body. Consequently, it is often necessary to use a loudspeaker of increased robustness inside the sound generator. This increases cost and may, due to the increased rigidity of the membrane involved therewith, and reduces the acoustic performance of the loudspeaker at low frequencies.

In order to solve this problem, DE 10 2013 208 186 A1 suggests to couple the pressure compensation valve to the sound generator via a long pressure compensation line, allowing the pressure compensation valve to be placed at any (and thus well protected) position on the vehicle. This, however, increases the effort for mounting the sound generator considerably.

A further problem with the configuration described above is that, when the exhaust system is submerged into water, an increased pressure is applied from outside to the membrane. This results in the membrane no longer oscillating around its rest position but rather on a plane spaced from this rest position, and thus having an offset. An oscillation of the offset membrane further results in the rear volume being pumped out through the pressure compensation valve.

The above problems are also present, when the sound generator is not in fluid communication with the exhaust system different to the sound generator shown in FIGS. 1A and 1B. Also in this case the membrane and a casing of the sound generator enclose a rear volume so that a pressure compensation valve is also required here. For a sound generator that is not in fluid communication with the exhaust system there is also an increased risk of a membrane offset due to an increased outside pressure.

SUMMARY OF THE INVENTION

It is therefore an object of the present invention to provide a sound generator for a system for manipulating noises, and in particular exhaust noise, from vehicles driven by an internal combustion engine which reliability is improved, particularly with respect to an immersion of the sound generator into water. The sound generator is further supposed to be manufactured cost-efficiently and to be robust in mounting and operation.

Embodiments of a sound generator for manipulating noises from a vehicle comprise a casing, a loudspeaker, and at least one pressure compensation valve. The term "loudspeaker" is hereby understood as that part of the sound generator that transduces electrical signals into mechanical oscillations (sound). In combination with the casing, the loudspeaker encloses a volume. Thus, this volume, also referred to as rear volume, is confined by the casing (and in particular by the inner surface of the casing) and the loudspeaker. To achieve this, the loudspeaker is in particular coupled to the casing in a gastight manner. The loudspeaker may thereby be located partly or completely inside the casing or directly adjacent to the casing. The pressure compensation valve provides a fluid communication between the volume enclosed by the loudspeaker together with the casing and an outside of the casing. The pressure compensation valve is thereby positioned to extend through a plane in which (along which) the loudspeaker is disposed. The plane in which the loudspeaker is disposed may be defined by a loudspeaker membrane or a loudspeaker basket and oriented, e.g., orthogonal to the main emission direction of sound emitted from the loudspeaker. Alternatively, the plane in which the loudspeaker is disposed may, for instance, be defined by respective fasteners formed at the casing. If the loudspeaker is a voice coil loudspeaker having a loudspeaker membrane and a voice coil carried by the loudspeaker membrane, the plane in which the loudspeaker is located may be any plane orthogonal to a main emission direction of sound emitted from the loudspeaker and located between the voice coil and a part of the loudspeaker membrane furthermost from the voice coil. According to an embodiment the part of the loudspeaker membrane furthermost from the voice coil shall be the part of the loudspeaker membrane that is most remote from the voice coil in a direction of symmetry of the loudspeaker membrane. According to an embodiment, the part of the loudspeaker membrane furthermost from the voice coil shall be the part of the loudspeaker membrane that is connecting the loudspeaker membrane to a basket of the loudspeaker.

Since the pressure compensation valve extends through the plane along which the loudspeaker is disposed, a pressure difference actually present between the two sides of the loudspeaker is relieved. The pressure compensation valve thus enables a particularly precise pressure compensation. Furthermore, any pumping out of the volume enclosed by the loudspeaker and the casing by the loudspeaker is avoided when the pressure outside of the volume enclosed by the loudspeaker and the casing but in front of the loudspeaker rises.

According to an embodiment, the casing is made from an inherently stable solid material like a metal sheet, and in particular a stainless steel panel, or synthetic material, and in particular acrylonitrile butadiene styrene (ABS), polyamide (PA), polylactide (PLA), poly(methyl methacrylate) (PMMA), polycarbonate (PC), polyethylene terephthalate (PET), polyethylene (PE), polypropylene (PP), polystyrene (PS), polyether ether ketone (PEEK), or polyvinyl chloride (PVC). According to an embodiment, the casing is made either integrally or from several parts.

According to an embodiment, the casing comprises fastening eyelets or fastening anchors enabling the casing to be mounted on a vehicle and in particular on the undercarriage of a vehicle.

According to an embodiment, the casing is configured for being coupled to an exhaust system of a vehicle driven by an internal combustion engine, in particular by using an additional bell mouth, so as to be brought into fluid communication with exhaust gas traveling through the exhaust system.

According to an embodiment, the at least one pressure compensation valve comprises a valve body and a valve head, thus being formed from several parts. The valve body comprises a first end having a first opening formed therein which opens to the outside of the casing. The valve body comprises also a second end having a second opening formed therein. The first and second ends may be located opposite each other. The second opening accommodates the valve head at the second end of the valve body such that the valve head seals the second opening. The valve head is located inside the volume enclosed by the loudspeaker and the casing. The valve head includes a through hole for air that opens out into the volume enclosed by the loudspeaker and the casing. The valve body thus serves to supply the valve head with air from outside the casing and to introduce the air supplied via the valve head into the volume enclosed by the loudspeaker and the casing, or to discharge air received from the volume enclosed by the loudspeaker and the casing via the valve head into the surroundings of the casing. Hence, the valve body is (at least not primarily) used for transmitting airborne sound to the outside of the casing as in the case of a bass reflex port. For a transmission of sound related air pressure and air density variations, the ability of the valve head to let air pass through is not adequate due to the valve head responding too slowly. Using a pressure compensation valve constituted by a valve body and a valve head enables a versatile positioning of the valve head in the volume enclosed by the loudspeaker and the casing. The valve head may thereby be located at the position located at the highest point when the sound generator is mounted to a vehicle with the vehicle being in a horizontal position. The valve body also provides the pressure compensation valve with a certain air volume that can be used for a pressure compensation when the sound generator is immersed into water. Accordingly, the valve body also serves as an air reservoir. According to an embodiment, the air reservoir that is formed by the valve body is distinct from an internal volume of a tubing connecting the pressure compensation valve to the outside of the casing of the sound generator; however, this does not prevent the air reservoir formed by the valve body from working together with the internal volume of the tubing connecting the pressure compensation valve to the outside of the casing of the sound generator. According to an embodiment, the air reservoir that is formed by the valve body and/or a tubing connecting the pressure compensation valve to the outside of the casing of the sound generator is provided fully or in part inside the casing of the sound generator.

According to an embodiment, the valve body is made from an inherently stable solid material like a metal sheet, and in particular a stainless steel panel, or synthetic material, and in particular acrylonitrile butadiene styrene (ABS), polyamide (PA), polylactide (PLA), poly(methyl methacrylate) (PMMA), polycarbonate (PC), polyethylene terephthalate (PET), polyethylene (PE), polypropylene (PP), polystyrene (PS), polyether ether ketone (PEEK), or polyvinyl chloride (PVC). The valve body may, however, also be made from a flexible material like an elastomer. The valve body may be formed integrally or in several parts; the valve body may in particular be made up of a first body of solid material (as for instance a barrel) and a second body of flexible material (as for instance a tube), with the inner volumes of both bodies being in fluid communication with each other. If the valve body is made of the first and second body, the tubing connecting the pressure compensation valve to the outside of the casing may be part of the valve body, according to an embodiment.

According to an embodiment, the at least one pressure compensation valve is disposed inside the casing with the valve body being dimensioned such that the valve body is disposed opposite to the plane in which the loudspeaker is located and at a maximum distance to the plane in which the loudspeaker is located. Since the loudspeaker is usually oriented downwards when the sound generator is mounted on a vehicle, the positioning of the valve body enables pressure compensation even when the sound generator is immersed completely in water. The feature "at a maximum distance" thereby indicates a positioning, where the valve body is as far away as possible from the plane in which the loudspeaker is located, but which still guarantees an adequate operation of the valve head. According to an embodiment, the feature "at a maximum distance" should be complied with when the distance between the valve body and a plane in which the loudspeaker is located (the loudspeaker extends along a loudspeaker plane) corresponds to at least ⅔ of a distance between an inner surface of the casing and the plane, with the distance being measured at a right angle to this plane.

According to an embodiment, the loudspeaker is disposed between the valve head and the first end of the valve body. Accordingly, the valve body is shaped and dimensioned to allow a respective positioning of the valve head.

According to an embodiment, the valve body comprises a section between the first opening and the second opening, where a diameter of the valve body is enlarged with respect to a diameter of the first and/or second opening. The thus formed broadening of the valve body constitutes an air reservoir that can be used for pressure compensation. According to an embodiment, the air reservoir that is formed by the broadening of the valve body is distinct from an internal volume of a tubing connecting the pressure compensation valve to the outside of the casing of the sound generator; this does not exclude that the air reservoir that is formed by the broadening of the valve body acts in combination with the internal volume of the tubing connecting the pressure compensation valve to the outside of the casing. According to an embodiment, the air reservoir that is formed by the broadening of the valve body is provided fully or in part inside the casing of the sound generator. According to an embodiment, an inner diameter of the valve body is compared with an inner diameter of the first and/or second opening.

According to an embodiment, the volume enclosed by the valve body between the first opening and the second opening amounts to between 1% and 20% or between 4% and 15% of the volume enclosed by the loudspeaker and the casing. A respective volume attunement usually guarantees a sufficient pressure compensation even when the sound generator is completely immersed into water.

According to an embodiment, the valve head comprises a membrane in its interior, the membrane being permeable to air and impermeable to water, and closing the through hole of the valve head. Respective membranes are known to a person skilled in the art; they may, for example, be made from acrylate copolymers.

According to an embodiment, the through hole of the valve head forms a throttle enabling, for a constant pressure difference of 300 Pa, a passage of more than 2 liters of air per hour and less than 10 liters of air per hour, or of more than 3 liters of air per hour and less than 9 liters of air per hour, or of more than 4 liters of air per hour and less than 8 liters of air per hour. The constant pressure difference is thereby used to determine the rate of flow of the throttle only. With the sound generator being in operation, the pressure difference is not constant.

According to an embodiment, the loudspeaker itself is gastight.

According to an embodiment, the loudspeaker comprises a loudspeaker basket, a membrane retained by the loudspeaker basket in an airtight manner, a permanent magnet retained by the loudspeaker basket, and a voice coil retained by the voice coil carrier. Thereby, the voice coil is positioned in a constant magnetic field created by the permanent magnet and connected to the membrane. In other words, the loudspeaker may be a voice coil loudspeaker. The loudspeaker is further coupled to the casing in an airtight manner. Furthermore, the valve body may extend through the loudspeaker basket. Alternatively, the valve body may be coupled to the loudspeaker basket in an airtight manner with the first opening of the valve body being aligned with an opening formed in the loudspeaker basket. Accordingly, the first opening of the valve body may be positioned in the same plane, where also the membrane or the loudspeaker basket of the loudspeaker are located.

The membrane may for instance be funnel-shaped, or spherically-dome-shaped, or have a non-developable NAWI-shape, as is usual for voice coil loudspeakers. The membrane may further be coupled to the loudspeaker basket by an airtight surround. Non-developable, bell-mouthed, or spherically-dome-shaped membranes are particularly rigid and enabling the membrane to move uniformly over its entire surface. Alternatively, also a conical membrane will do.

According to an embodiment, the membrane is airtight and coupled to the loudspeaker basket by an airtight surround. This allows an adjustment of the membrane's oscillation behavior by an appropriate material selection and dimensioning of the surround. According to an embodiment, surround and membrane are further made from different materials.

According to an embodiment, the loudspeaker basket carries a centering device, and in particular a centering spider, coupled to the voice coil carrier or to the membrane in the region of the voice coil carrier. It is emphasized that the centering device may be expendable, when the voice coil is guided inside the permanent magnet generally frictionless.

According to an embodiment, the membrane is made from metal, and in particular from aluminum or titanium, or from synthetic material, and in particular from aromatic polyamides.

According to an embodiment, the loudspeaker is coupled to a bell mouth located inside the casing in an airtight manner. Thus, inside the casing, also the bell mouth confines the volume enclosed by the loudspeaker and the casing. The first opening of the valve body may then be aligned with an opening formed in the bell mouth. The bell mouth may be configured for being arranged in fluid communication with an exhaust system of a vehicle driven by an internal combustion engine.

According to an embodiment, the valve body is formed integrally with the loudspeaker basket or the casing or permanently fixed to the loudspeaker basket or the casing. A portion of the loudspeaker basket or of the casing may thus form a wall of the valve body.

According to an embodiment, the volume enclosed by the loudspeaker and the casing is, except for the pressure compensation valve, enclosed in an airtight manner (enclosed airtight).

According to an embodiment, the casing of the sound generator is formed in one piece. According to an alternative embodiment, the casing of the sound generator is composed of an upper shell and a lower shell airtightly coupled to the upper shell. The upper shell and/or the lower shell may thereby have at least one airtight passage for a control line connected with the loudspeaker.

According to an embodiment, the at least one pressure compensation valve is fully contained inside the casing of the sound generator.

Embodiments of a system for manipulating sound waves propagating through exhaust systems of vehicles driven by an internal combustion engine comprise a controller either configured for being coupled to an engine control unit of the vehicle by a control line or built-in into the engine control unit of the vehicle, and at least one sound generator as described above. A control line then connects the loudspeaker of the at least one sound generator with the controller. The controller is further configured to generate a control signal based on signals received from the engine control unit and to output the control signal via the control line to the loudspeaker. The control signal is thereby adapted to cancel the sound waves propagating through the exhaust system of the vehicle completely or to some extent, when the control signal is used to operate the loudspeaker.

Embodiments of a motor vehicle comprise an internal combustion engine having an engine controller, an exhaust system in fluid communication with the internal combustion engine, and the system described above. The at least one sound generator of the system is thereby in fluid communication with the exhaust system. Further, the controller of the system is connected with the engine controller of the vehicle's internal combustion engine.

In this context, it is noted that the terms "including", "comprising", "containing", "having" and "with", as well as grammatical modifications thereof used in this description and the claims for listing features, are generally to be considered to specify a non-exhaustive listing of features such as method steps, components, ranges, dimensions or the like, and do by no means preclude the presence or addition of one or more other features or groups of other or additional features.

Further features of the invention will be apparent from the following description of exemplary embodiments together with the claims and the Figures. In the Figures, equal or similar elements are assigned equal or similar reference signs. It is noted that the invention is not limited to the configurations of the exemplary embodiments described herein, but defined by the scope of the claims enclosed. Embodiments according to the invention may in particular implement individual features in different numbers and combination than the examples described below. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

FIG. 1A is a schematic perspective illustration of a sound generator of a system for manipulating sound waves propagating through exhaust systems of vehicles driven by an internal combustion engine according to the prior art;

FIG. 1B is a schematic cross-section through the sound generator of FIG. 1A;

FIG. 5 is a schematic illustration of a motor vehicle having the system of FIG. 4 built-in.

DESCRIPTION OF THE PREFERRED EMBODIMENTS

Figure 2A:
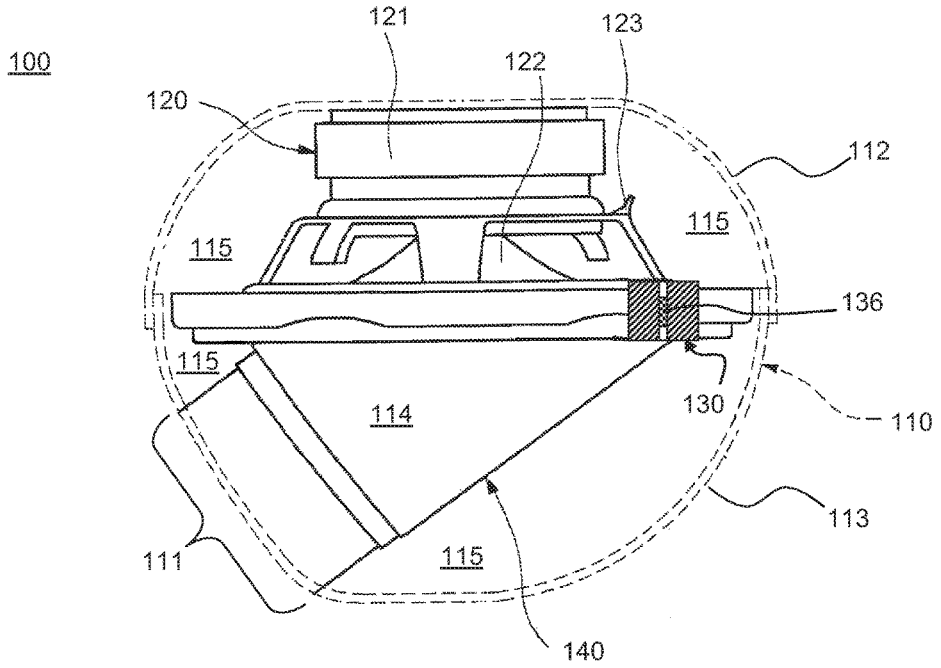
FIG. 2A is a schematic cross-section through a sound generator for mounting on a vehicle to manipulate vehicle noise according to a first embodiment of the invention.

Referring to the drawings, a sound generator according to a first embodiment of the invention is described referencing FIG. 2A. FIG. 2A thereby shows a cross-section through the sound generator 100 in a schematic view.

The sound generator 100 shown in FIG. 2A comprises a casing 110 formed from a lower shell 113 and an upper shell 112 coupled to the lower shell 113 in an airtight manner. Both, the lower shell 113 and the upper shell 112 are made from a stainless steel panel.

The lower shell 113 of the casing 110 includes a casing aperture 111 and receives a bell mouth 140 also made from a stainless steel panel. In the region of the casing aperture 111 an outside of the bell mouth 140 is coupled to the lower shell 113 of the casing 110 in an airtight manner. An opening of the bell mouth 140 is aligned with the casing aperture 111 of the sound generator 100. The bell mouth 140 of the embodiment illustrated is configured for being coupled to an exhaust system as shown in FIG. 1A for a prior art sound generator. The bell mouth 140 is coupled to a loudspeaker basket 123 of a voice coil loudspeaker 120 received in the casing 110 and made from sheet steel in an airtight manner. Accordingly, the loudspeaker basket 123 is coupled to the casing 110 via the bell mouth 140 in an airtight manner.

The voice coil loudspeaker 120 comprises a permanent magnet 121 made from a neodymium iron boron alloy and a non-developable bell mouthed membrane 122 made from synthetic material, both of which are carried by the loudspeaker basket 123. Thereby, the bell mouthed membrane 122 is at the radial outside of its base area coupled to the loudspeaker basket 123 in an airtight manner by an elastic surround 126 (see FIG. 3A) made from synthetic material. The top face of the bell mouthed membrane 122 is centrally sealed by a synthetic material covering cap in an airtight manner. In the region of the covering cap, a voice coil carrier 125 (see FIG. 3A) carrying the voice coil (not shown) is fixed to the membrane 122. The voice coil is positioned in a constant magnetic field generated by the permanent magnet 121. The permanent magnet 121 comprises respective recesses for this. When an alternate current is applied to the voice coil, the voice coil exerts, due to the Lorentz force, a force onto the membrane 122 causing it to oscillate. The current is supplied to the voice coil by means of control lines (only shown in FIG. 1A) passing into the inside of the sound generator 100 through an airtight cable bushing (only shown in FIG. 1A) at the upper shell 122 of the casing 110.

The voice coil loudspeaker 120 and the bell mouth 140 separate a volume 114, that is in fluid communication with an exhaust system via the bell mouth 140 and the casing aperture 111 of the sound generator 100, from a volume 115, that is confined by the upper shell 112 and the lower shell 113 of the casing 110 and also an outside of the bell mouth 114 and in the following referred to as rear volume, in an airtight manner. Accordingly, the voice coil loudspeaker 120 with the bell mouth 123 and the casing 110 together define an enclosed rear volume 115 separated from the atmosphere or the exhaust system by the membrane 122 of the voice coil loudspeaker 120 and a part of the loudspeaker basket 123.

A pressure compensation valve 130 is received inside the casing 110 of the sound generator 100 for enabling a pressure compensation between this enclosed rear volume 115 and the volume 114 at the other side of the membrane 122 of the voice coil loudspeaker 120. The pressure compensation valve 130 is composed of a valve body and a valve head 132. The valve body is not shown for the embodiment of FIG. 2A, since it is an integral part of a housing of the valve head 132. The pressure compensation valve 130 thus penetrates a portion of the loudspeaker basket 123 of the voice coil loudspeaker 120. Hence, the pressure compensation valve 130 extends through the plane in which the membrane 122 of the voice coil loudspeaker 12 is positioned with respect to the casing 110.

The valve head 132 of the pressure compensation valve 130 includes a through hole 135 for air operating like a throttle. A membrane 136 is disposed inside the through hole 135, the membrane being permeable to air and impermeable to water. In the embodiment illustrated, the through hole 135 of the valve head 132 of the pressure compensation valve 130 is dimensioned to allow for a passage of 7.0 liters of air per hour at a constant pressure difference of 300 Pascal between the enclosed rear volume 115 and the volume 114 separated therefrom at the other side of the voice coil loudspeaker 120. The pressure compensation valve 130 is thus too slow to respond to variations in the air pressure generated inside the sound generator 100 by oscillations of the membrane 122 of the voice coil loudspeaker 120. It is noted that the constant pressure difference of 300 Pascal mentioned above is used to determine the flow rate through the pressure compensation valve only; in operation, the pressure difference varies however, and is reduced by the pressure compensation valve 130 continuously.

A second embodiment of the invention is discussed below referencing FIG. 2B. To avoid any repetitions thereby, only differences to the above first embodiment are addressed, and for the rest reference is made to the explanations of the first embodiment.

The sound generator 100 of the second embodiment differs from the sound generator 100 of the first embodiment by the pressure compensation valve 130 comprising a valve body 131 distinct from the valve head 132.

In the embodiment shown, the valve body 131 made in two parts from an elastomer includes a tubing and a barrel. The barrel is in fluid communication with the tubing. At its end facing away from the barrel, the tubing has a first opening 133 penetrating the loudspeaker basket 123 to open into the volume 114. Further, a second opening 134 is formed at the end of the tubing facing away from the barrel that accommodates the valve head 132 and is thus closed by the valve head 132. The through hole 135 formed in the valve head 132 opens into the enclosed rear volume 115. Between the first opening 133 and the second opening 134, the valve body 131 hence comprises a section 137 formed by the barrel (see FIG. 3A) wherein a diameter of the valve head 131 is increased with respect to a diameter of the first opening 133. The valve body 131 thus provides a volume in its interior that amounts, in the embodiment shown, to 5% of the rear volume 115 and enables a compensation of pressure differences between the two sides of the voice coil loudspeaker's 120 membrane 122 even when the sound generator 100 is immersed into water.

Figure 2B:
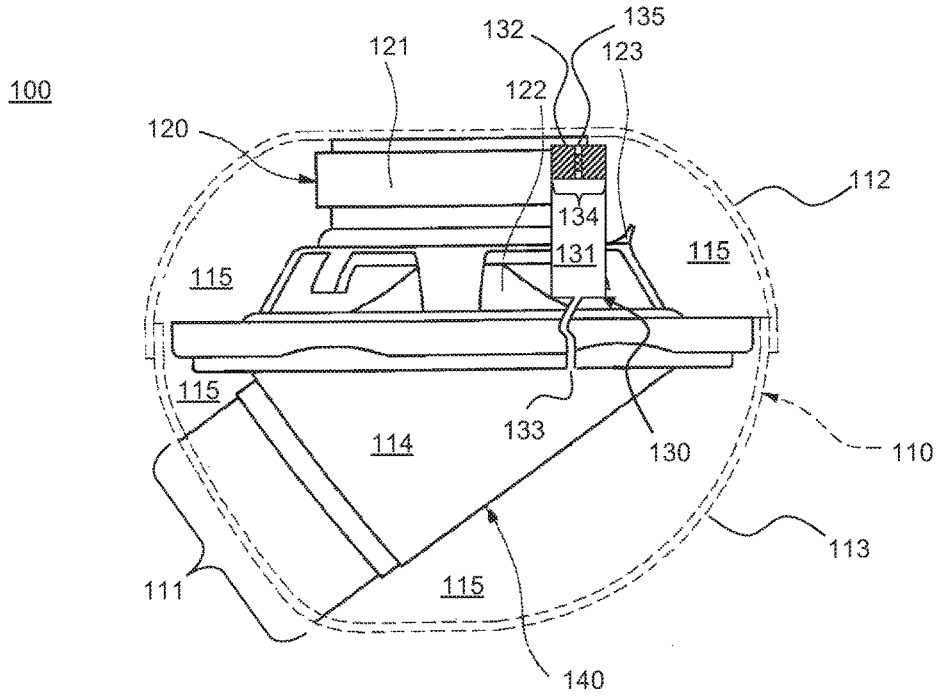
FIG. 2B is a schematic cross-section through a sound generator for mounting on a vehicle to manipulate vehicle noise according to a second embodiment of the invention.

In the embodiment illustrated in FIG. 2B, the valve body 131 is configured for the valve head 132 supported by the valve body 131 being positioned at a maximum distance from the plane in which the loudspeaker 120 is disposed at the casing 110 and opposite this plane. As can be seen, the valve head 132 is located in the rear volume 115.

Figure 2C:
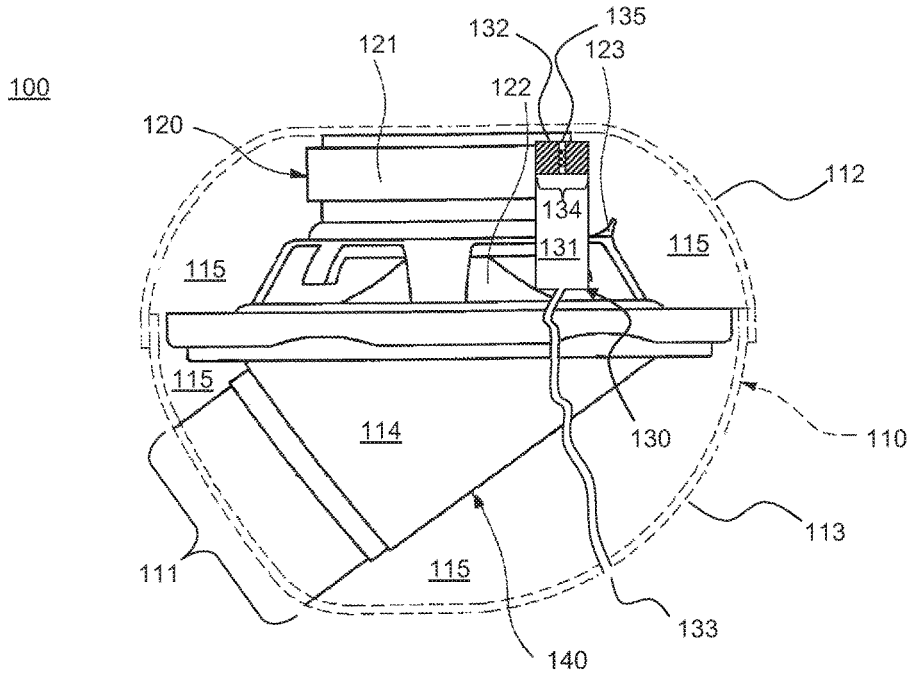
FIG. 2C is a schematic cross-section through a sound generator for mounting on a vehicle to manipulate vehicle noise according to a third embodiment of the invention.

A third embodiment of the invention is discussed below referencing FIG. 2C. To avoid any repetitions thereby, only differences to the above second embodiment are addressed, and for the rest reference is made to the explanations of the second embodiment.

The sound generator 100 according to the third embodiment differs from the sound generator of the second embodiment in that the first opening 133 of the valve body's 131 tubing does not open into the exhaust system but rather into the outside of the casing 110 after penetrating the lower shell 113 of the casing 110. In this embodiment, the valve body 131 therefore allows for a pressure compensation between the rear volume 115 and atmosphere.

In the following, different operating conditions of a sound generator according to a fourth embodiment of the invention are discussed referencing FIGS. 3A to 3D. To avoid any repetitions thereby, only differences to the above second embodiment are addressed, and for the rest reference is made to the explanations of the second embodiment.

The sound generator 100 of the fourth embodiment differs from the sound generator 100 of the second embodiment in that the second opening 134 of the valve body 131 has a diameter bigger than the diameter of the first opening 133 of the valve body 131 but smaller than the diameter of the valve body 131 in the section 137 having an increased diameter/cross-section between the first opening 133 and the second opening 134.

Further, no bell mouth is present inside the casing 110 of the sound generator 100 according to the fourth embodiment, and the casing 110 is also not made in two parts by an upper shell and a lower shell. The casing is rather made cup-shaped from polyvinyl chloride and is sealed by the loudspeaker basket 123 of the voice coil loudspeaker 120 supported by the casing 110. This results in the voice coil loudspeaker 120 separating the rear volume 115 enclosed by the loudspeaker 120 and the casing 110 from the air 114' at the other side of the voice coil loudspeaker 120. Hence, the rear volume 115 communicates also in this case only through the pressure compensation valve 130 with air 114' on the other side of the voice coil loudspeaker 120.

Figure 3A:
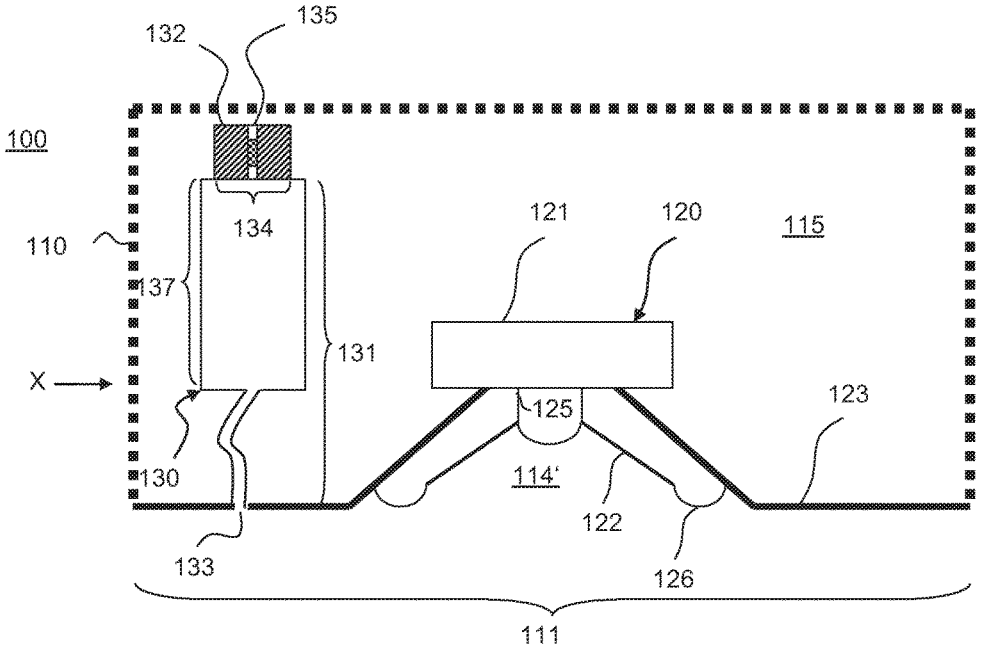
FIG. 3A is a schematically drawn cross-section through a sound generator for mounting on a vehicle to manipulate vehicle noise according to a fourth embodiment of the invention in a first operating condition.

FIG. 3A illustrates a first operating condition, where only air 114' surrounds the sound generator 100. A pressure compensation between the rear volume 115 and the air 114' on the other side of the voice coil loudspeaker 120 through the pressure compensation valve 130 is possible without any problems.

Figure 3B:
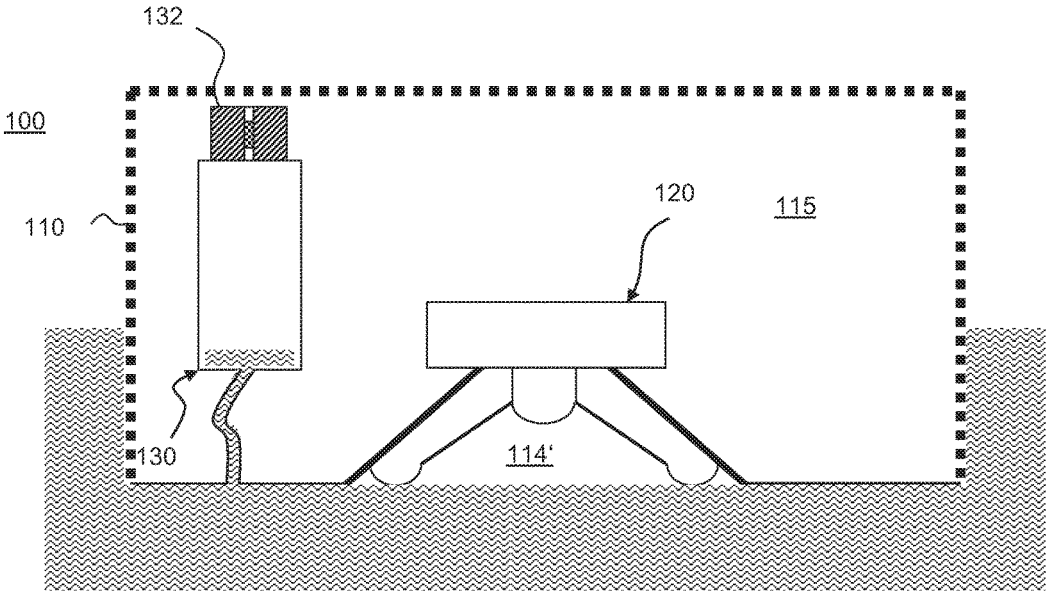
FIG. 3B is a second operation condition of the sound generator of FIG. 3A.

FIG. 3B illustrates a second operating condition, where the sound generator 100 shown in FIG. 3A is partly immersed into water (in the Figure illustrated by wiggly lines). In this case a bubble of compressed air 114' forms in front of the voice coil loudspeaker's 120 membrane 122.

Figure 3C:
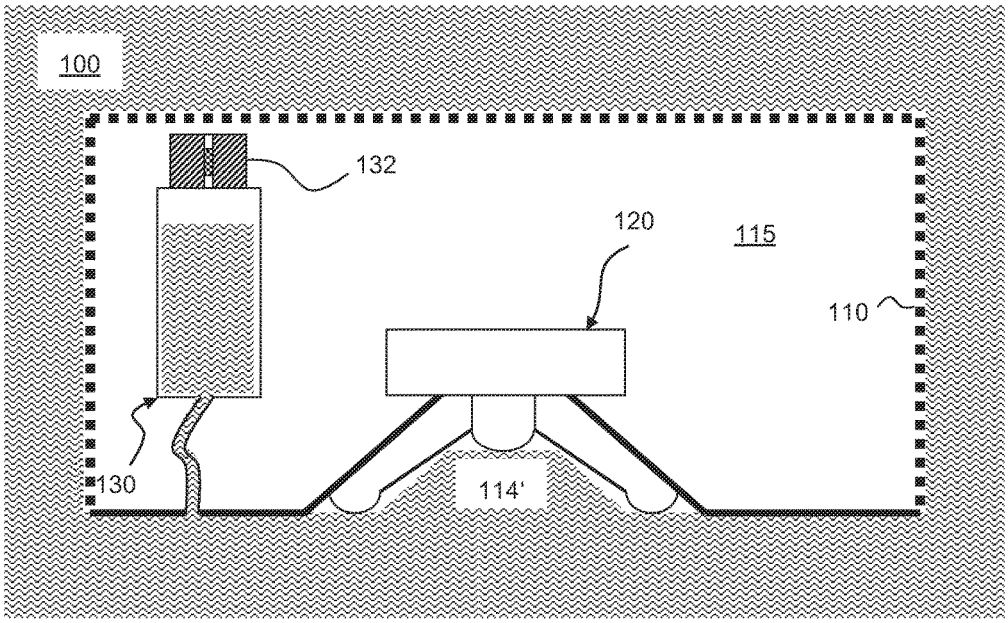
FIG. 3C is a third operation condition of the sound generator of FIG. 3A.

FIG. 3C illustrates a third operating condition, where the sound generator 100 shown in FIG. 3A is completely immersed into water (in the Figure illustrated by wiggly lines). The air, usually contained inside the valve body 131, is pushed by the water having entered into the valve body through the first opening 133 of the valve body 131 almost completely into the rear volume 115 of the casing 110 thereby establishing a pressure compensation between the rear volume 115 and the other side of the voice coil loudspeaker 120 to a certain degree.

Figure 3D:
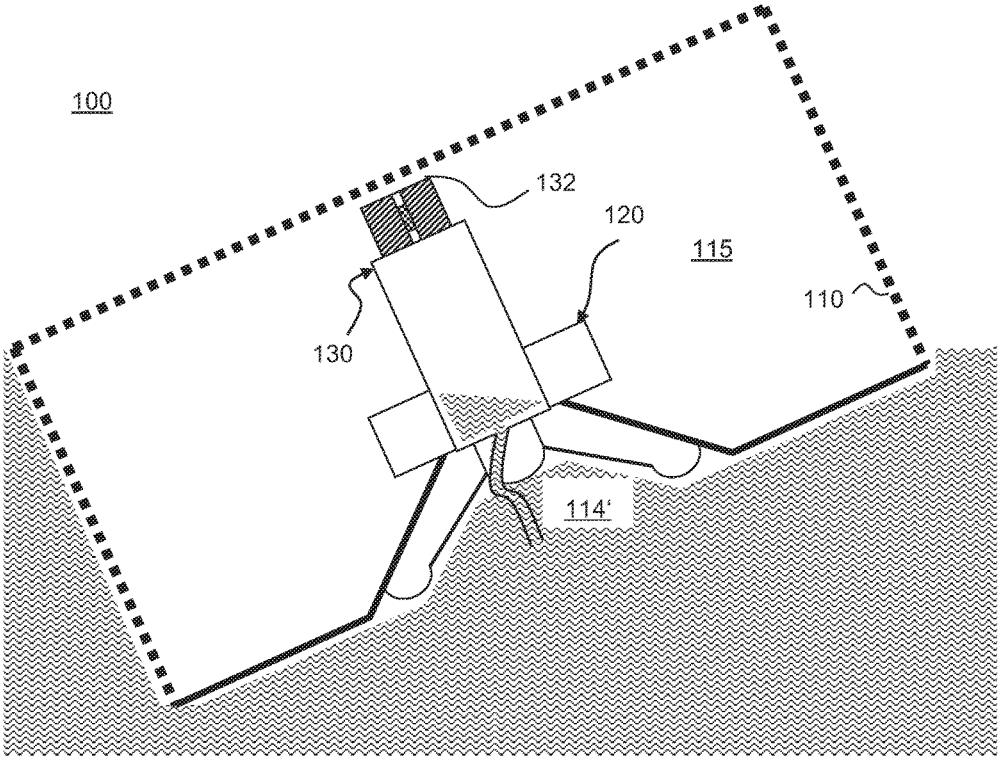
FIG. 3D is a fourth operation condition of the sound generator of FIG. 3A in a view rotated with respect to FIG. 3A.

FIG. 3D illustrates a fourth operating condition, where the sound generator 100 shown in FIG. 3A is canted into water (in the Figure illustrated by wiggly lines). FIG. 3D thereby shows the sound generator illustrated in FIG. 3A in a view along direction X. As can be seen, the first opening 133 of the valve body 131 is positioned in the tilt axis around which the sound generator 100 is canted.

Figure 4:
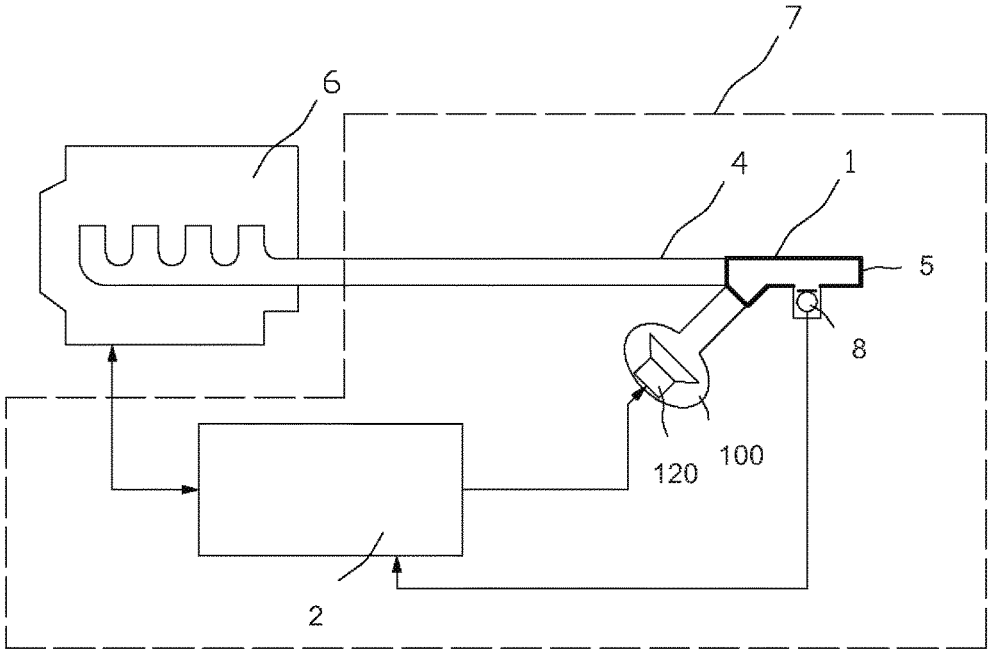
FIG. 4 is a block diagram of a system for manipulating sound waves propagating through exhaust systems of vehicles driven by an internal combustion engine according to an embodiment of the invention.

FIG. 4 shows a schematic diagram of a system 7 for manipulating sound waves propagating through exhaust systems of vehicles driven by an internal combustion engine, the system employing the above sound generator 100.

The sound generator 100 is coupled to an exhaust system 4 in the region of a discharge opening 5 by a Y-pipe 1. Exhaust gas traveling through the exhaust system 4 is discharged from the discharge opening 5 into the exterior together with sound generated by the sound generator 100.

An error microphone 8 in the form of a pressure sensor is provided at the Y-pipe 1. The error microphone 8 measures pressure variations and thus sound inside the Y-pipe 1 in a section downstream of a region, where the sound generator 100 is coupled in fluid communication to the exhaust system 4. It is noted, however, that the error microphone is only optional.

The voice coil loudspeaker 120 of the sound generator 100 and the error microphone 8 are electrically connected to a controller 2. The controller 2 is coupled to an engine controller of an internal combustion engine 6 by a CAN bus. It is noted that the present invention is not limited to a CAN bus.

The exhaust system 4 may further comprise at least one catalytic converter (not shown) located between the internal combustion engine 6 and the Y-pipe 1 for cleaning the exhaust gases emitted from the internal combustion engine 6 that travel through the exhaust system 4.

The general operation of the above system 7 for manipulating sound waves propagating through exhaust systems of vehicles driven by an internal combustion engine is as follows: Using the sound measured by the error microphone 8 and/or operating parameters of the internal combustion engine 6 received via the CAN bus, the controller 2 calculates control signals using a Filtered-x Least Mean Squares (FxLMS) algorithm. The control signals enable a desired manipulation of the sound (exhaust noise) originating from an operation of the internal combustion engine 6 and propagating through the interior of the exhaust system 4 by applying engineered sound produced in the sound generator 100. The controller 2 outputs these control signals via the control lines to the voice coil loudspeaker 120 of the sound generator 100.

Although a system 7 using the sound generator of the first embodiment for manipulating sound waves propagating through exhaust systems of vehicles driven by an internal combustion engine has been described above, alternatively also the sound generator of the second embodiment which is not in fluid communication with the exhaust system may be used.

Figure 5:
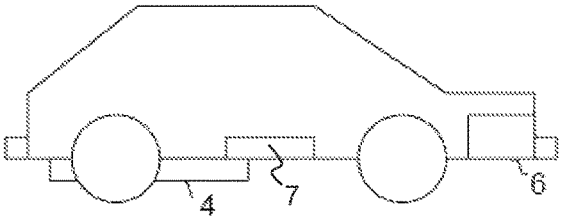

FIG. 5 shows a schematic illustration of a motor vehicle having an internal combustion engine 6, an exhaust system 4, and the above system 7 for manipulating sound waves propagating through exhaust systems of vehicles driven by an internal combustion engine. The sound generator and the loudspeakers of the anti-noise system are not explicitly shown in FIG. 5.

For the sake of clarity, the Figures show only those elements, components, and functions that are beneficial for the understanding of the present invention. Embodiments of the invention are, however, not limited to the elements, components, and functions shown, but may comprise further elements, components, and functions if necessary for their use or scope of functions.

While the above embodiments of the present invention have been described by way of example only, it is apparent to those skilled in the art that numerous modifications, additions and substitutions can be made without departing from the scope and gist of the invention disclosed in the following claims. While specific embodiments of the invention have been shown and described in detail to illustrate the application of the principles of the invention, it will be understood that the invention may be embodied otherwise without departing from such principles.

What is claimed is:

1. A system for manipulating sound waves propagating through an exhaust system of a vehicle driven by an internal combustion engine, the system comprising:

a controller connected to an engine controller of the vehicle by a control line or built-in into the engine controller of the vehicle; and at least one sound generator comprising:

a casing;

a loudspeaker, the loudspeaker and the casing together enclosing a volume and the loudspeaker extending along a loudspeaker plane; and at least one pressure compensation valve, the pressure compensation valve coupling the volume enclosed by the loudspeaker and the casing with an outside of the casing and the pressure compensation valve extending through the loudspeaker plane, the at least one pressure compensation valve comprising a valve body and a valve head, the valve body having a first end with a first opening formed therein that opens to the outside of the casing, and a second end with a second opening accommodating the valve head, the valve head being disposed inside the volume enclosed by the loudspeaker and the casing, the valve head including a through hole for air, the first opening of the valve body being located in the loudspeaker plane;

a control line connecting the loudspeaker to the controller, wherein the controller is configured to generate a control signal based on signals received from the engine controller and to output the control signal to the loudspeaker via the control line, the control signal being adapted to cancel the sound waves propagating through the exhaust system of the vehicle to some extent or completely, when the control signal is used to operate the loudspeaker.

2. A system according to claim 1, wherein the valve head comprises a membrane in a valve head interior, the membrane being permeable to air and impermeable to water and closing the through hole.

3. A system according to claim 1, wherein the loudspeaker comprises:

a loudspeaker basket;

a membrane retained airtight by the loudspeaker basket;

a permanent magnet retained by the loudspeaker basket;

a voice coil retained by a voice coil carrier, the voice coil being located in a constant magnetic field generated by the permanent magnet and the voice coil being coupled to the membrane wherein:

the loudspeaker basket is coupled airtight to the casing; and the valve body penetrates the loudspeaker basket or the valve body is coupled airtight to the loudspeaker basket with the first opening of the valve body being aligned with an opening formed in the loudspeaker basket.

4. A system according to claim 1, wherein the at least one pressure compensation valve is positioned in the casing and the valve body is dimensioned such that the valve head is disposed opposite the loudspeaker plane and is located at a maximum distance to the loudspeaker plane.

5. A system according to claim 1, wherein the valve body includes an increased diameter section between the first opening and the second opening and a diameter of the increased section of the valve body is increased with respect to a diameter of the first opening or the second opening or both the first opening and the second opening.

6. A system according to claim 5, wherein the increased diameter section is fully or in part located inside the casing.

7. A system according to claim 1, wherein a volume enclosed by the valve body between the first opening and the second opening amounts to between 1% and 20% of the volume enclosed by the loudspeaker and the casing.

8. A system according to claim 1, wherein a volume enclosed by the valve body between the first opening and the second opening amounts to between 4% and 15% of the volume enclosed by the loudspeaker and the casing.

9. A system according to claim 1, wherein the through hole of the valve head is a throttle enabling, at a constant pressure difference of 300 Pa and a passage of more than 2 liters of air per hour and less than 10 liters of air per hour.

10. A system according to claim 1, wherein the through hole of the valve head is a throttle enabling, at a constant pressure difference of 300 Pa and a passage of more than 3 liters of air per hour and less than 9.0 liters of air per hour.

11. A system according to claim 1, wherein the through hole of the valve head is a throttle enabling, at a constant pressure difference of 300 Pa and a passage of more than 4 liters of air per hour and less than 8 liters of air per hour.

12. A system according to claim 1, wherein the valve body is formed integrally with the casing.

13. A system according to claim 1, wherein the loudspeaker comprises:

a loudspeaker basket;

a membrane retained airtight by the loudspeaker basket;

a permanent magnet retained by the loudspeaker basket;

a voice coil retained by a voice coil carrier, the voice coil being located in a constant magnetic field generated by the permanent magnet and the voice coil being coupled to the membrane wherein:

the loudspeaker basket is coupled airtight to the casing; and the valve body penetrates the loudspeaker basket or the valve body is coupled airtight to the loudspeaker basket with the first opening of the valve body being aligned with an opening formed in the loudspeaker basket.

14. A system according to claim 13, wherein the valve body is integrally formed with the loudspeaker basket.

15. A system according to claim 1, wherein the loudspeaker comprises:

a loudspeaker basket;

a membrane retained airtight by the loudspeaker basket;

a permanent magnet retained by the loudspeaker basket; and a voice coil retained by a voice coil carrier, the voice coil being located in a constant magnetic field generated by the permanent magnet and being coupled to the membrane, wherein:

the loudspeaker basket is coupled airtight to the casing; and the loudspeaker plane is oriented orthogonally to a main emission direction of sound emitted from the loudspeaker and is positioned between the voice coil and a section of the membrane furthermost from the voice coil.

16. A sound generator for mounting on a vehicle to manipulate vehicle noise, the sound generator comprising:

a casing;

a loudspeaker, the loudspeaker and the casing together enclosing a volume and the loudspeaker extending along a loudspeaker plane; and at least one pressure compensation valve, the pressure compensation valve coupling the volume enclosed by the loudspeaker and the casing with an outside of the casing and the pressure compensation valve extending through the loudspeaker plane, the at least one pressure compensation valve comprising a valve body and a valve head, the valve body having a first end with a first opening formed therein that is open to the outside of the casing, and a second end with a second opening accommodating the valve head, the valve head being disposed inside the volume enclosed by the loudspeaker and the casing, the valve head including a through hole for air, wherein the through hole is always in constant gas communication with the volume enclosed by the loudspeaker and the casing, the first opening and the second opening, the first opening of the valve body being located in the loudspeaker plane, the valve head comprising a valve head interior and a membrane in the valve head interior, the membrane being permeable to gas and impermeable to water and closing the through hole, wherein only gas passes from the valve body and the valve head to the volume enclosed by the loudspeaker and the casing via the through hole.

17. A sound generator according to claim 16, wherein the loudspeaker comprises a loudspeaker basket, at least a portion of the at least one pressure compensation valve penetrating the loudspeaker basket.

* * * * *